US010918204B2

(12) United States Patent
Fleck

(10) Patent No.: US 10,918,204 B2
(45) Date of Patent: Feb. 16, 2021

(54) ART WORKSTATION

(71) Applicant: Phillip R. Fleck, Hilliard, OH (US)

(72) Inventor: Phillip R. Fleck, Hilliard, OH (US)

( * ) Notice: Subject to any disclaimer, the term of this patent is extended or adjusted under 35 U.S.C. 154(b) by 0 days.

(21) Appl. No.: 16/054,046

(22) Filed: Aug. 3, 2018

(65) Prior Publication Data

US 2019/0239638 A1 Aug. 8, 2019

Related U.S. Application Data

(60) Provisional application No. 62/626,985, filed on Feb. 6, 2018.

(51) Int. Cl.

| | |
|---|---|
| ***A47B 13/00*** | (2006.01) |
| ***A47B 13/08*** | (2006.01) |
| ***A47B 17/06*** | (2006.01) |
| ***A47B 83/00*** | (2006.01) |
| ***A47B 1/04*** | (2006.01) |
| ***A47B 27/00*** | (2006.01) |
| ***A47B 85/02*** | (2006.01) |
| *A47B 67/04* | (2006.01) |
| *A47B 83/02* | (2006.01) |

(52) U.S. Cl.

CPC ..... *A47B 13/081* (2013.01); *A47B 1/04* (2013.01); *A47B 17/06* (2013.01); *A47B 27/00* (2013.01); *A47B 83/001* (2013.01); *A47B 85/02* (2013.01); *A47B 67/04* (2013.01); *A47B 83/021* (2017.08); *A47B 2200/0045* (2013.01)

(58) Field of Classification Search

CPC ..... A47B 13/081; A47B 17/06; A47B 96/18; A47B 1/04; A47B 27/00; A47B 83/001; A47B 83/02; A47B 2200/0045; A47B 83/021; A47B 67/04; A47B 37/00; A47B 2037/005; A47B 88/988; A47B 88/994; A47B 88/42; A47B 88/433; A47B 88/48; A47B 2210/0056; A47B 13/08

USPC ..... 312/277, 241, 235.3, 111, 311, 239

See application file for complete search history.

(56) References Cited

U.S. PATENT DOCUMENTS

| | | | | | |
|---|---|---|---|---|---|
| 486,435 | A | * | 11/1892 | Conde | |
| 1,331,862 | A | * | 2/1920 | Claus | B65D 21/023 206/511 |
| 1,349,634 | A | * | 8/1920 | Stern | A47B 43/02 190/12 A |
| 2,555,644 | A | * | 6/1951 | Heer | A47B 46/005 312/317.1 |
| 2,659,642 | A | * | 11/1953 | Records | A47B 83/02 312/235.3 |

(Continued)

FOREIGN PATENT DOCUMENTS

| | | | |
|---|---|---|---|
| DE | 102008011785 | * | 6/2009 |
| KR | 20150067499 | * | 6/2015 |

*Primary Examiner* — Janet M Wilkens

(74) *Attorney, Agent, or Firm* — Bryce D. Miracle

(57) ABSTRACT

A workstation for use by children and adults for providing categorization and organization of art supplies and materials by theme. The workstation provides one or more art containers which are uniquely paired with a corresponding art tray. Certain versions of the workstation comprise an extendable and collapsible top working surface among other unique features such as providing a plurality of stowaway foldable chairs and other art accessories for making art fun in an all-in-one style art workstation.

15 Claims, 12 Drawing Sheets

(56) References Cited

U.S. PATENT DOCUMENTS

| | | | | | |
|---|---|---|---|---|---|
| 2,669,499 | A * | 2/1954 | Vanderplank | E06B 3/5045 | 312/322 |
| 3,206,266 | A * | 9/1965 | Holloway | A01K 97/06 | 312/216 |
| 3,355,231 | A * | 11/1967 | Kegel | A47B 88/90 | 312/45 |
| 3,873,114 | A * | 3/1975 | Brown | A47B 31/00 | 280/30 |
| 4,114,965 | A * | 9/1978 | Oye | A47B 31/00 | 312/209 |
| 5,098,174 | A * | 3/1992 | Worthley | A47B 81/02 | 108/26 |
| 5,533,799 | A * | 7/1996 | Nickolaus, Jr. | A47B 81/00 | 312/209 |
| 6,003,924 | A * | 12/1999 | Nicol | B60R 11/06 | 296/37.6 |
| 8,292,379 | B2 * | 10/2012 | Hernandez | A47B 46/00 | 312/249.12 |
| 2002/0093275 | A1 * | 7/2002 | Waisbrod | E05C 19/14 | 312/322 |
| 2007/0159037 | A1 * | 7/2007 | Hoffman | E05D 15/58 | 312/322 |
| 2007/0241649 | A1 * | 10/2007 | Thomas Carter | A47B 67/04 | 312/290 |

* cited by examiner

Detail "A"

Section A-A

ART WORKSTATION

RELATED U.S. PROVISIONAL APPLICATION

This application is based upon and claims the priority filing date of the previously filed, U.S. Provisional patent application entitled "EXPANDABLE ART STATION FOR CHILDREN" filed Feb. 6, 2018, Ser. No. 62/626,985, the entire disclosure of which is hereby incorporated herein by reference.

FIELD OF THE INVENTION

The present invention relates to the field of desks, particularly with regard to an expandable art workstation and corresponding art supplies, tools, and accessories.

BACKGROUND

A desk or workstation is a piece of furniture with a flat table-style work surface used primarily in school, office, home or the like for academic, professional or domestic activities such as reading, writing, or other artistic activities. Desks often have one or more drawers, compartments, or pigeonholes to store items such as supplies and other materials.

However, currently in the art, desks are not well suited for providing a highly organizable and usable workstation, particularly when used for the creation of visual arts and other artistic activities. Different areas of the visual arts or creative themes require a multitude of varying art supplies, each area to utilize certain art brushes, tools, and materials among others. For example, some of the visual art categories/themes include: airbrushing, ceramics, crafts, pencil drawings, painting (acrylic, oil, tempera, and watercolors), fingerpainting, printmaking, screen printing, sculpture, and scrapbooking, etc. Again, each of these visual art categories requires different tools, materials, and accessories that should be maintained and grouped separately while stored among the other categories while maintained within a workstation. Tools, materials, and accessories may include pencils, erasers, pens, paper, watercolor papers, masonite, canvas, acrylics, oils, watercolor, inks, palettes, brushes, varnishes, etc.

Put simply, current workstation technology fails to teach or suggest a desk which effectively simplifies the organization of tools and materials relating to different visual art themes while providing adequate workspace to create visual arts thereon within each category.

SUMMARY

In accordance with certain versions of the application, a workstation is provided which is designed for use by children and adults for providing categorization and organization of art supplies and materials by theme. The workstation provides one or more art containers which are uniquely paired with a corresponding art tray—each pair identified by a unique art theme. Certain versions of the workstation comprise an extendable and collapsible top working surface among other unique features such as providing a plurality of stowaway foldable chairs and other art accessories for making art fun in an all-in-one style art station, particularly for use by children.

In a certain version of the application, the art workstation generally comprises a desk assembly forming a box-like storage cavity having a first side frame, a second side frame, rear side frame, and a top portion having at least one working surface. The art workstation includes a plurality of grouped art containers arranged within the storage cavity within a first location, and a plurality of grouped art trays arranged within the storage cavity at a second location, wherein each of the containers and trays are configured to be independently slidably removable from the storage cavity. In certain versions, each art tray identifies a unique art theme which corresponds and partners with an art container identifying the same unique art theme.

In a version of the workstation, the grouped art containers are vertically arranged at a first level and the grouped art trays are vertically arranged at a second, elevated level.

In another version, the workstation may further comprise a front portion that has a pair of slidable doors which are configured to slide apart, merge and conceal with the corresponding profile of the first and second side frames for accessing the storage cavity.

In yet another version of the application, the workstation may further comprise an extendable top portion which has a static working surface having opposing sides and a movable planar structure having a first working surface and an opposing second working surface. The movable planar structure is hingedly connected near where the top portion merges with one of the side frames. A support leg structure is hingedly connected to the movable planar structure. The extendable top portion extends from a collapsed position to a laterally extended position, wherein while in the collapsed position, only the first working surface is exposed and while in the laterally extended position, only the static working surface and the second working surface is exposed forming together an overall working surface supported at a distal end by the support leg structure.

In certain versions of the application, the workstation may further include a plurality of foldable chairs arranged within the storage cavity at a third level.

In some versions, each of the art trays includes a means for coupling with one of the working surfaces.

These and other features of the present invention will become readily apparent upon further review of the following specification and drawings.

BRIEF DESCRIPTION OF THE DRAWINGS

These and other features, aspects, and advantages of the present invention will become better understood with regard to the following description and accompanying figures where.

DETAILED DESCRIPTION

In the following description, for purposes of explanation and not limitation, specific details are set forth such as particular architectures, interfaces, techniques, etc. in order to provide a thorough understanding of the present invention. However, it will be apparent to those skilled in the art that the present invention may be practiced in other versions that depart from these specific details. In other instances, detailed descriptions of well-known devices, circuits, and methods are omitted so as not to obscure the description of the present invention with unnecessary detail.

Moreover, the description is not to be taken in the limiting sense but is made merely for the purpose of illustrating the general principles of the invention, since the scope of the invention is best defined by the appended claims. Various inventive features are described below that can each be used independently of one another or in combination with other features.

Unless otherwise defined, all technical terms used herein have the same meaning as commonly understood by one of ordinary skill in the art to which the invention belongs. As used in the specification and the appended claims, the singular forms "a," "an," and "the" include plural references unless the context clearly dictates otherwise. Any reference to "or" herein is intended to encompass "and/or" unless otherwise stated.

With reference to the figures, a description of a version of the invention will be provided and is generally designated as numeral 10. Generally, the application is directed towards a workstation 10 designed for use by adults and children for providing categorization and organization of art supplies and materials by theme. Namely, the workstation provides one or more art containers which are uniquely paired with a corresponding art tray identified by a unique art theme which will be described in detail below. Certain versions of the workstation 10 comprise an extendable and collapsible top working surface among other unique features such as providing a plurality of stowaway foldable chairs and other art accessories for making art fun in an all-in-one style art station, particularly for use by children.

Figure 1:
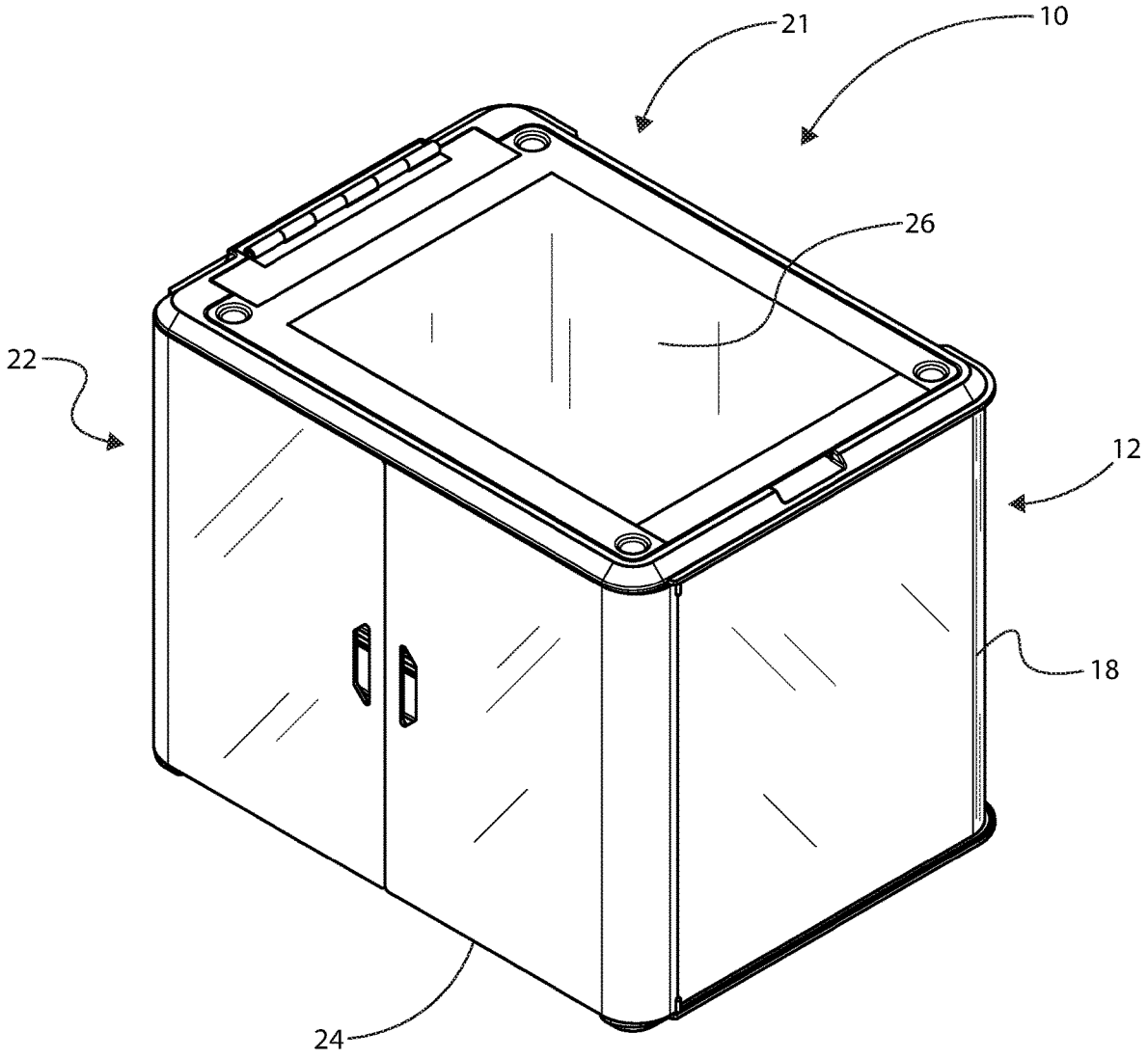
FIG. 1 is a front perspective view of a version of the application.
Figure 2:
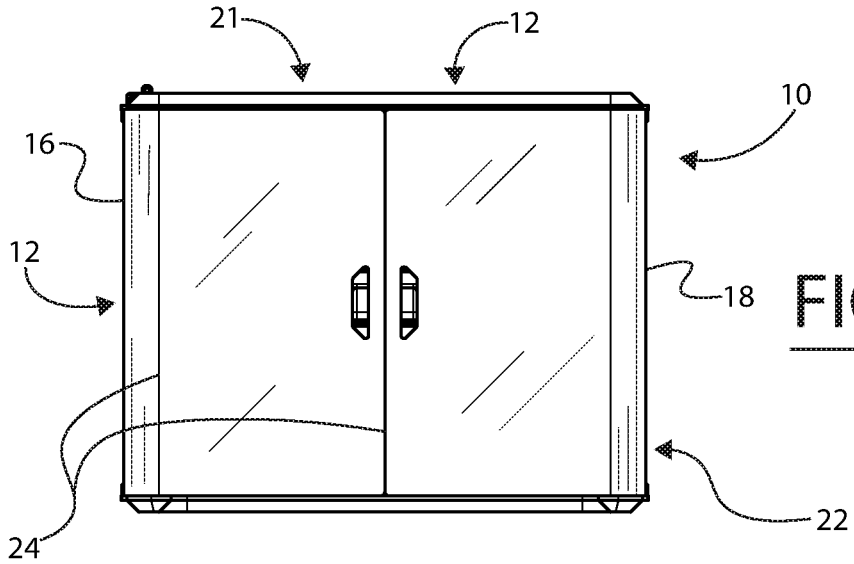
FIG. 2 front elevation view of the version shown in FIG. 1.
Figure 3:
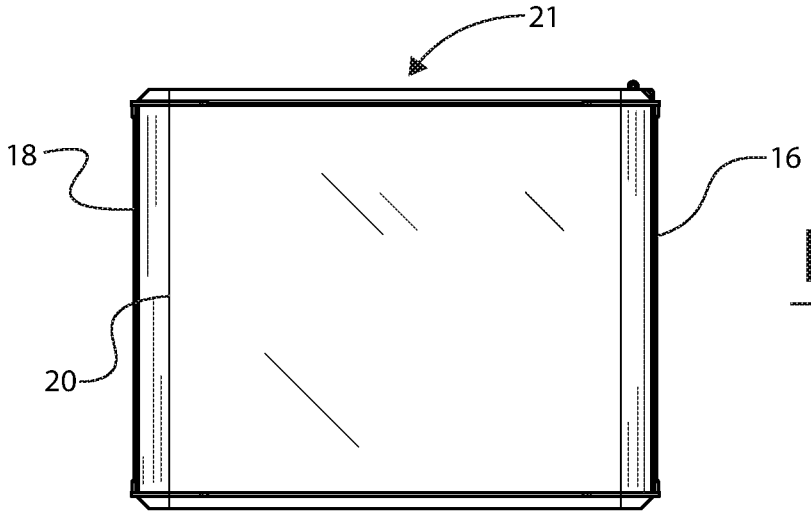
FIG. 3 is a rear elevation view of the version shown in FIG. 1.
Figure 4:
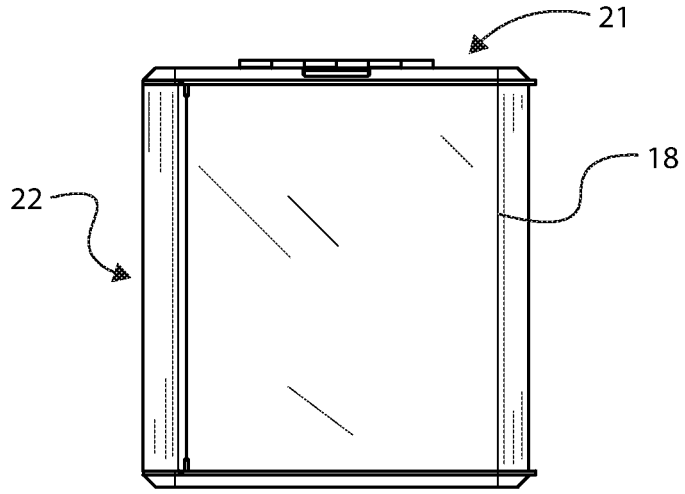
FIG. 4 is a right-side elevation view of the version shown in FIG. 1.
Figure 5:
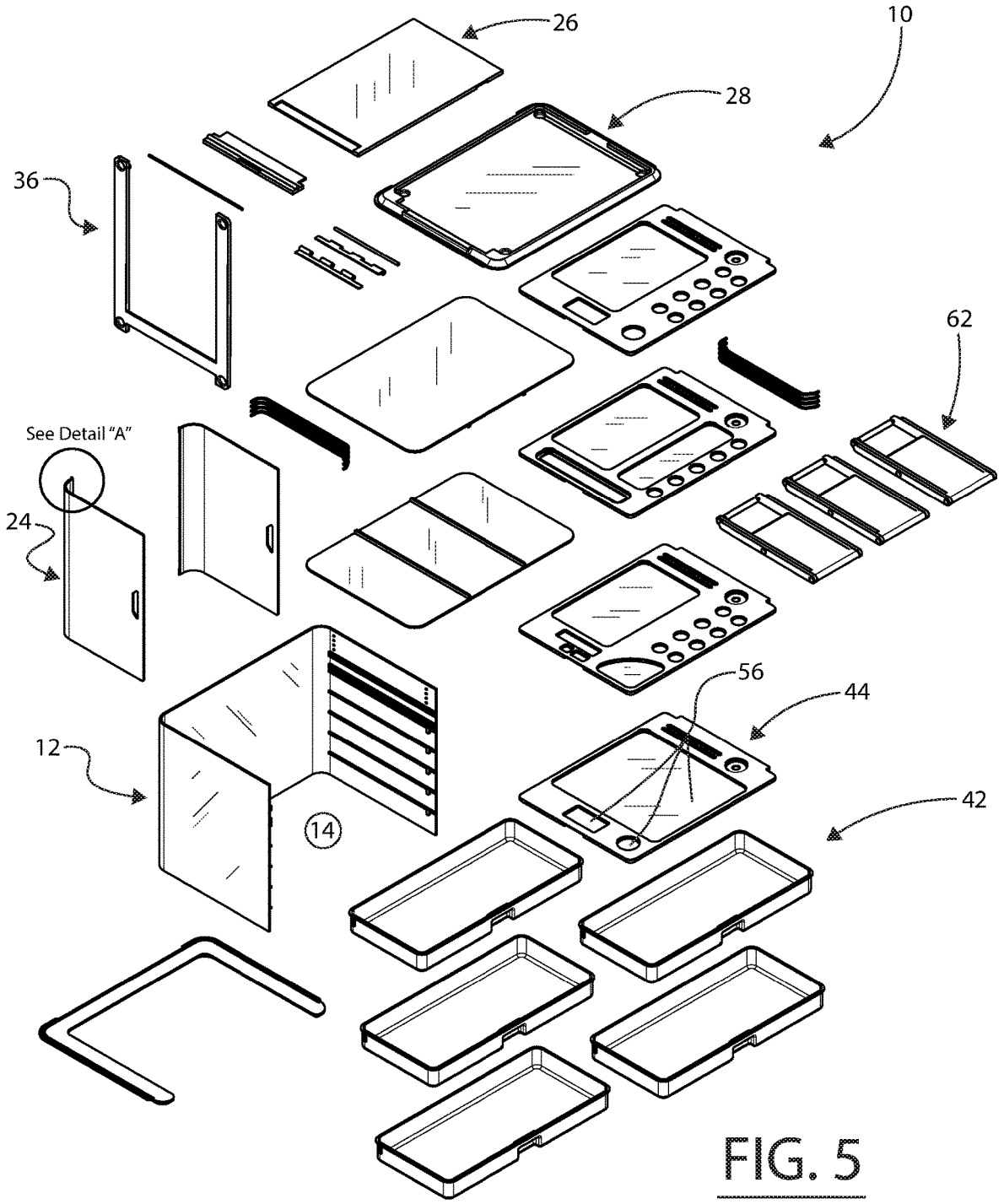
FIG. 5 is an unassembled part view of a version of the application.
Figure 6:
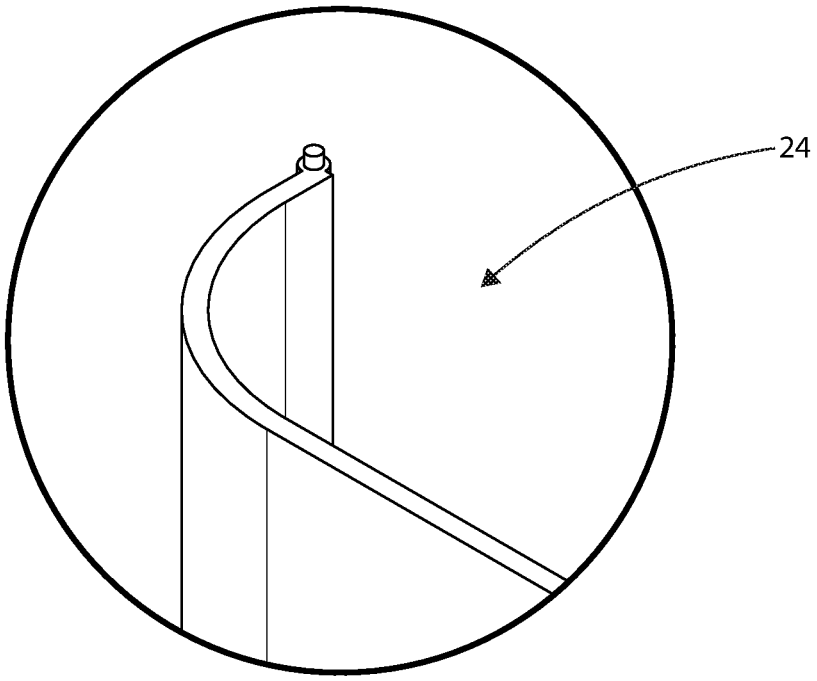
FIG. 6 is an up-close view taken from FIG. 5 identified as Detail A.
Figure 7:
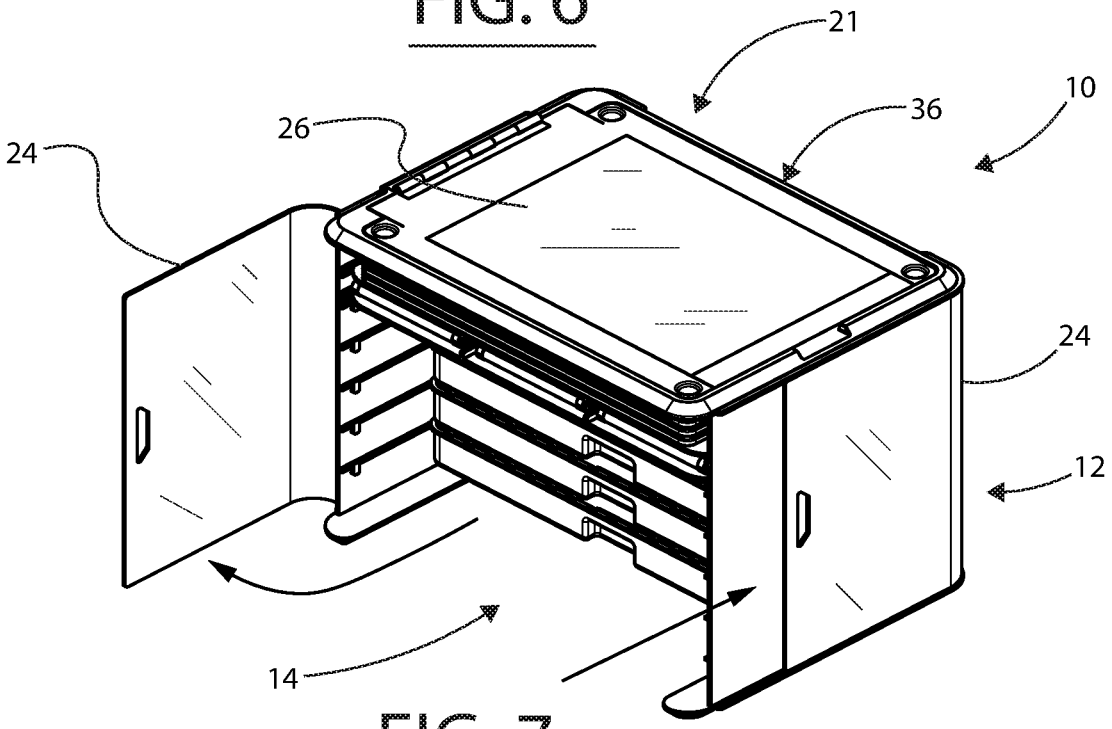
FIG. 7 is a front perspective view of the version shown in FIG. 1 showing operation of the slidable doors providing ingress to the storage cavity.

Initially referring to FIG. 1-FIG. 7, a version of the application provides a workstation 10 which generally comprises a desk assembly 12 or structure which forms a box-like storage cavity 14 therein having an accessible front portion 22. The desk assembly 12 generally includes a first side frame 16, a second side frame 18, a rear side frame 20, a top portion 21 and a front portion 22 which combine to form the overall box-like storage cavity 14 structure of the desk assembly 12. The front portion 22 is formed by a pair of slidable doors 24 which are configured open to provide access to the storage cavity 14 within the desk assembly 12 (FIG. 7). In the version, the pair of slidable doors 24 are configured to pivot apart, then operably slide to the rear in order to merge and conceal with the corresponding profile of the first and second side frames 16, 18 for accessing the storage cavity 14. In certain versions, the top portion 21 generally has a planar first working surface 26 while in a collapsed, default position.

Figure 8:
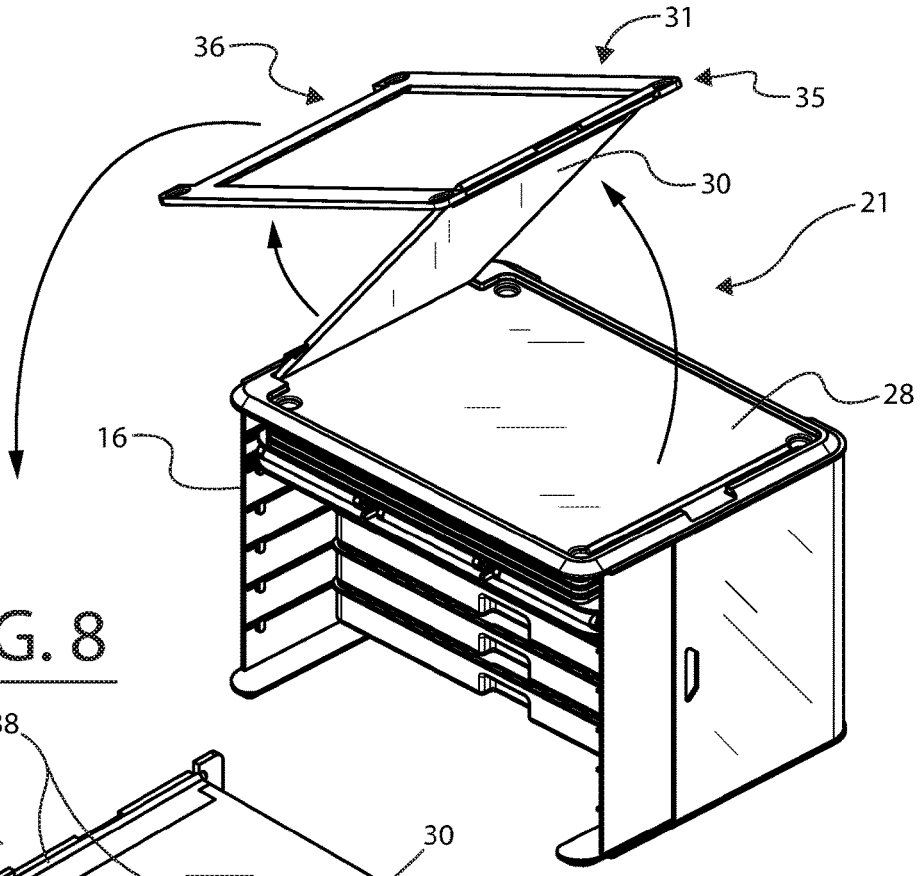
FIG. 8 is a front perspective view of the version shown in FIG. 1 while in transition between the collapsed position to the lateral extended position.
Figure 9:
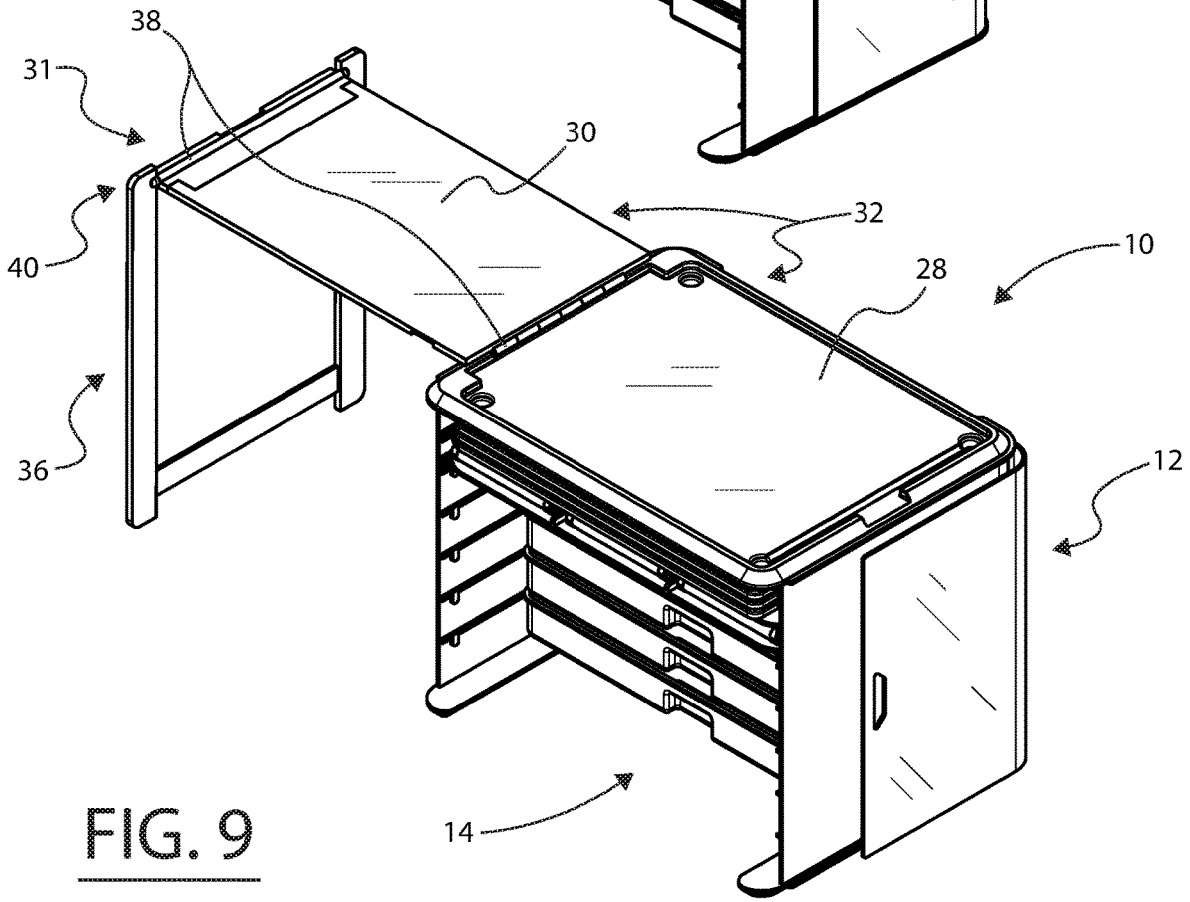
FIG. 9 is a front perspective view of the version shown in FIG. 1 while in the lateral extended position.

As best illustrated by FIG. 7-FIG. 9, in certain versions, the desk assembly 12 top portion 21 may be operably configured to optionally extend to provide an overall working surface 32 by moving between a collapsed position (FIG. 7) and a laterally extended position (FIG. 9). The extended overall working surface 32 (FIG. 9) enables the user additional space to conduct artistic and other activities or even provide additional space for artists to work side by side, ideally suited for multiple children during art activities. In the illustrated version, the top portion 21 comprises a static working surface 28 and a hinged movable planar structure 31 having a first working surface 26 and on the opposing side a second working surface 30.

As best illustrated by FIG. 8, the movable planar structure 31 is hingedly connected near the side of the top portion 21. In the illustrated version, the movable planar structure 31 generally laterally pivots in conjunction with a support leg structure 36 which is hingedly connected to the opposite side of the movable planar structure 31. Ideally, each of the movable planar structure 31 and the support leg structure 36 move within their respective paths of motion by way of a hinge 38 or other structure allowing the parts to pivot laterally to the side of the desk assembly 12 as best illustrated by FIG. 9.

In further detail, while the top portion 21 is in the collapsed position (FIG. 7), the movable planar structure 31 and the support leg structure 36 combine to rest flush on top of the static working surface 28 to form a substantially coplanar top portion 21 exposing only the first working surface 26. While the top portion 21 is in the laterally extended position (FIG. 9), the movable planar structure 31 flips and extends laterally to expose both the static working surface 28 and the second working surface 30 to form the extended overall working surface 32. The movable planar structure 31 is supported at a distal end 40 by the support leg structure 36 positioned to engage the adjacent ground surface. Ideally, the support leg structure 36 is provided in a rectangular, framed shape and is coplanar with the movable planar structure 31 while in the collapsed position. However, other versions may be envisioned which provide a supportive structure.

Now referring to FIG. 5, FIG. 9-FIG. 15, some versions of the workstation 10 may further comprise uniquely identified grouped containers 42 and corresponding identified grouped trays 44 which are paired based upon a common theme in order to provide an organized and streamlined approach to creating and employing various types of visual arts. In a version, the quantity of grouped art containers is equal to the quantity of the grouped art trays, wherein each tray identifies a unique art theme which corresponds and partners with a container which identifies the same unique art theme.

Figure 10:
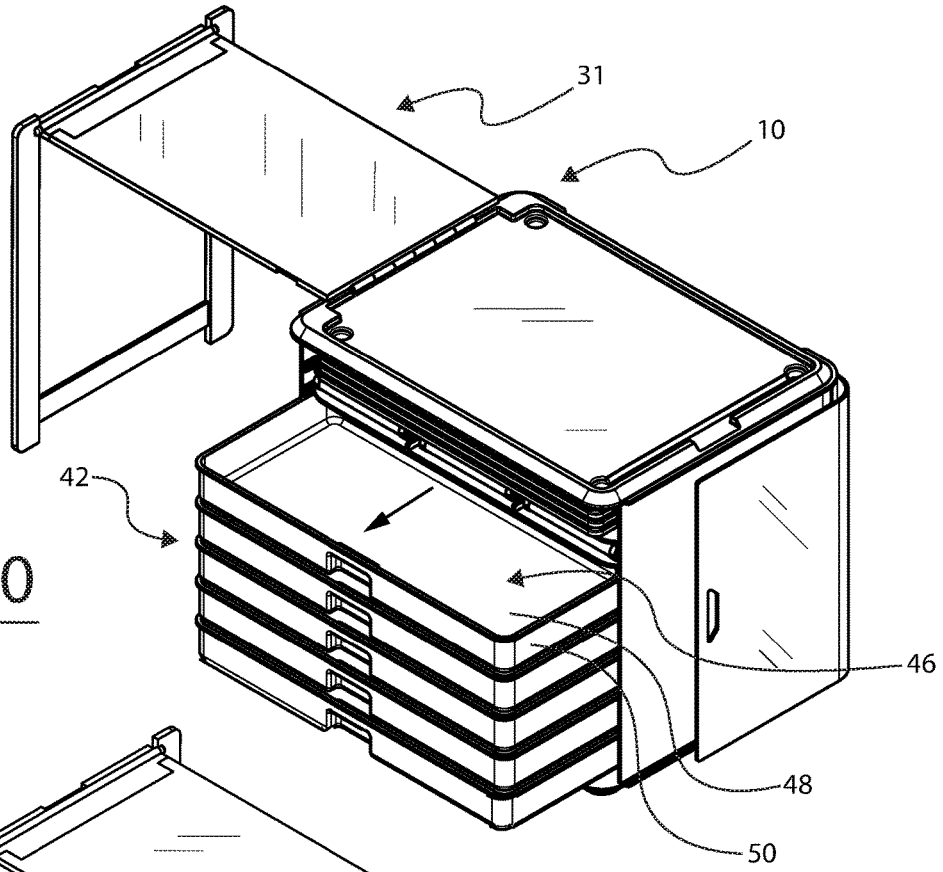
FIG. 10 is a front perspective view of the version shown in FIG. 1 while the art containers are in a pulled-out position.

Referring to FIG. 10, generally, the grouped art containers 42 each may provide an unhindered rectangular space 46 similar to a case having an open top or in other versions include various compartments therein. In particular, each art container 42 comprises a bottom 48 with upward extending sidewalls 50 forming an open top. The art containers 42 are generally independent of each other and for storage purposes are vertically arranged within the storage cavity 14 at a first location or designated level 52 (See FIG. 12). Preferably, the designated level is the bottom level or space of the desk assembly 12. However, other levels or specific locations within the storage cavity 14 can certainly be arranged within other embodiments. Each art container 42 is configured to be independently slidably removable from the storage cavity 14 by way of a pair of side rails 54 for each art container 42 (See FIG. 18).

Figure 11:
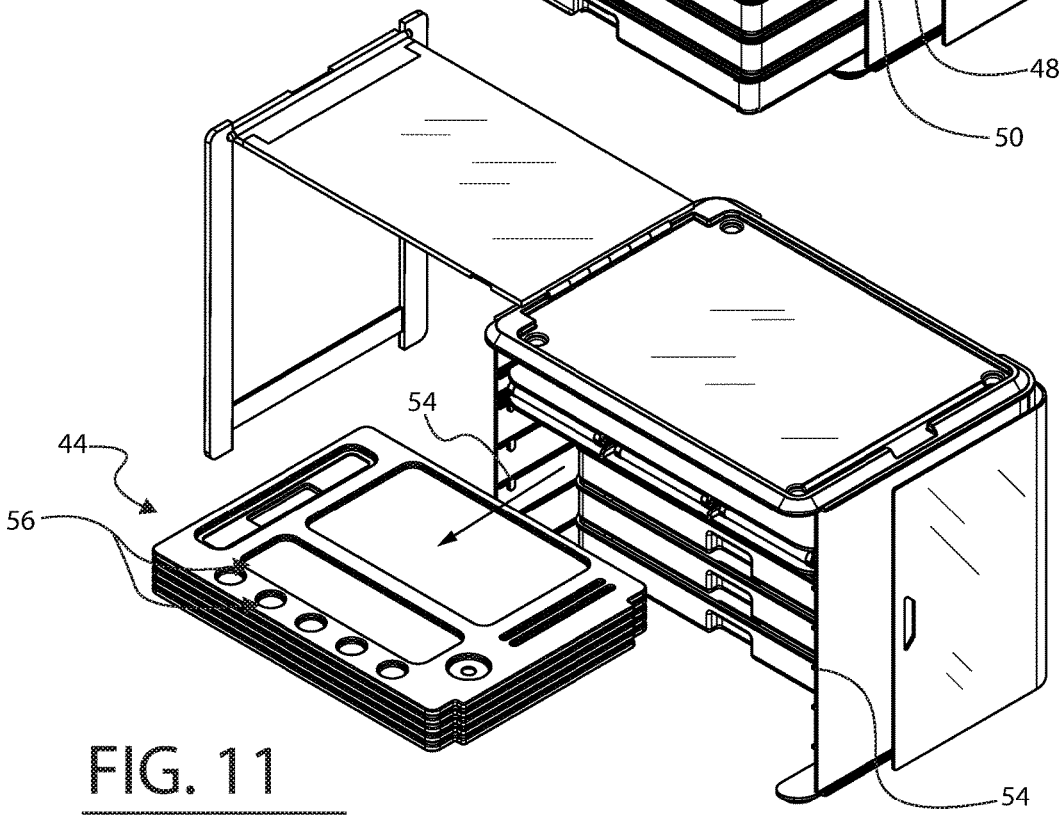
FIG. 11 is a front perspective view of the version shown in FIG. 1 showing the art trays removed from the art station.
Figure 12:
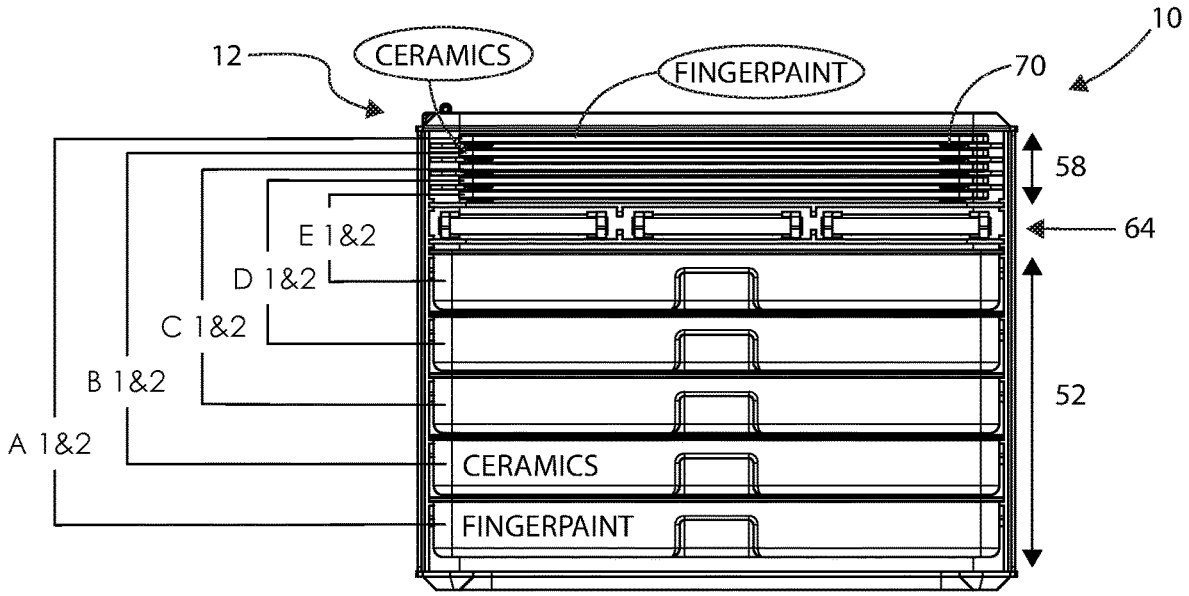
FIG. 12 is a front elevation view of the version shown in FIG. 1 showing the various levels of containers, trays, and chairs.

Referring specifically to FIG. 11 and FIG. 12, in the illustrated version, the grouped art trays 44 are generally rectangular having a short depth for providing a plurality of varying sized and shaped supply spaces 56 for receipt and storage of art materials and supplies.

Further as illustrated, the art trays 44 are generally independent of each other, and for storage purposes are vertically arranged within the storage cavity 14 at a second location or second designated level 58 (See FIG. 12). Preferably, the second location or second designated level 58 is above the art container 42 first designated level 52 and near the top of the storage cavity 14 for ease of access. Each art tray 44 is configured to be independently and slidably removable from the storage cavity 14 by way of a pair of front to rear extending slots 60, each slot positioned at the opposing first and second side frames 16, 18 (See FIG. 12 and FIG. 18). However, it will be noted that the art trays 44 can be configured to easily and collectively stack one on top of the other forming a stack of trays (See FIG. 11).

As mentioned above, and now referring to FIG. 12, a version of the workstation 10 designates corresponding art containers 42 with art trays 44 (See A-E 1&2) based upon a common artistic theme or task in order to provide an organized and streamlined method of creating and employing various types of visual art activities. For example, each unique art container 42 contains art supplies such as art brushes, tools, and materials among others relating to a specific art task or theme. Some, among many, of the art categories/themes may include: airbrushing, ceramics, crafts, pencil drawings, painting (acrylic, oil, tempera, and watercolors), sculpture, and scrapbooking, etc. Again, each of these visual art categories requires different tools, materials, and accessories that should be maintained and grouped separately while stored among the other categories while maintained in a desk.

Ideally, each corresponding art tray 44 and shaped supply spaces 56 are configured to suit the identified themed artistic task, such as providing the shaped supply spaces 56 in a specific formation that is particularly ideal for temporarily storing art supplies throughout an artistic task or activity. The shaped supply spaces 56 may be rectangular, square, circular, or formed as any other shape necessary for the temporary containment of materials and supplies such as a slot for pencils or cylinder for receipt of a circular paint container. Each art tray 44 may have differently shaped supply space 56 configurations and orientations which may better fit a certain artistic task or theme. See generally FIG. 5 for a variety of art tray 44 configurations suiting different artistic themes and corresponding art containers.

Figure 15:
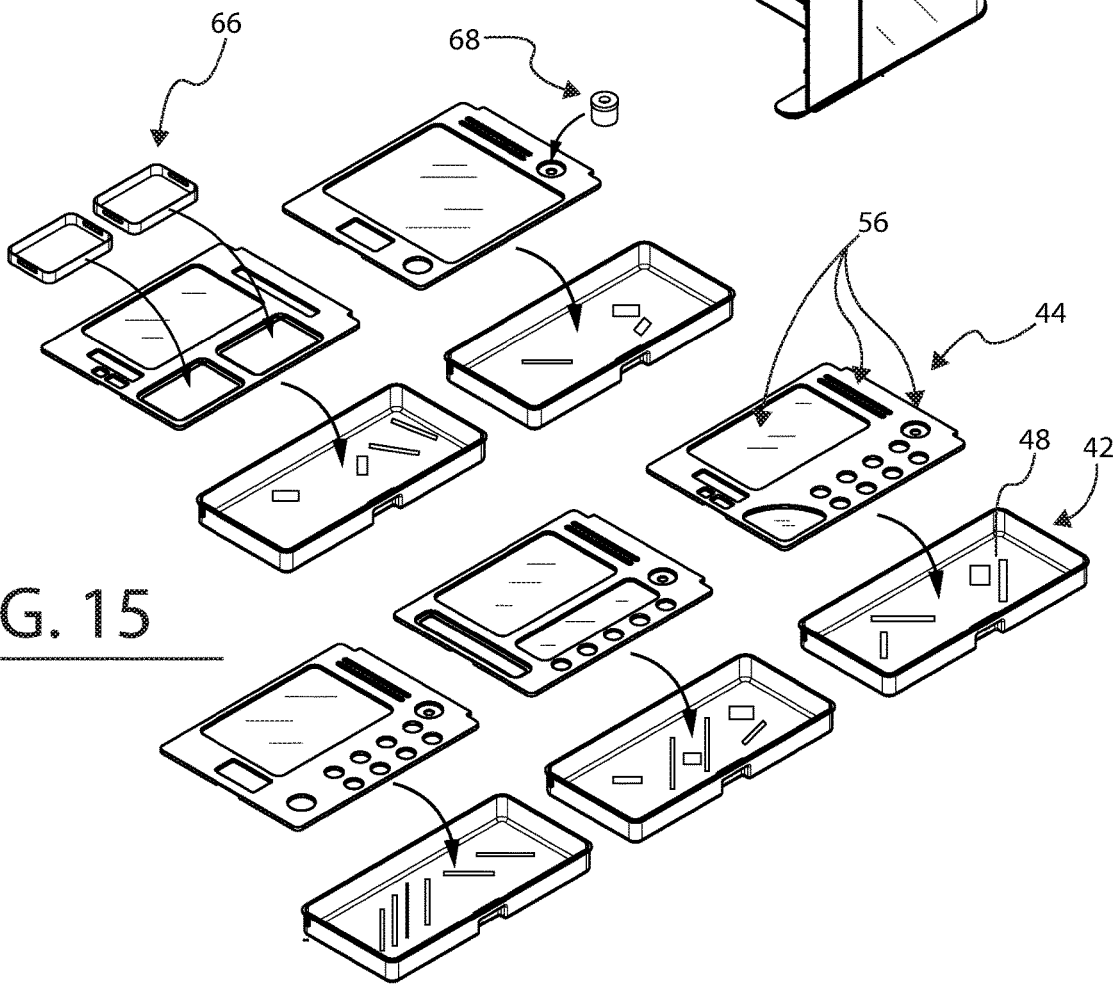
FIG. 15 is an illustration showing varying combinations of themed art containers and art trays.

Ideally, referring to FIG. 12, a version includes at least five art containers 42 with five paired art trays 44. Identification of pairing can be by way of labeling ("FINGER PAINT"), color coded, or even by way of a common symbol pictured on the exterior of both corresponding paired container and tray combination. For instance, a pictured paintbrush could be shown on the exterior of both the corresponsing art container 42 and art tray 44. The symbol designating the combination of paint supplies stored in the art container 42 with the corresponding art tray 44 which is tailored towards the size and shape of painting supplies. Again, the specific container and tray combination can be based on themes among many, such as crayons, finger paints, brush painting, ink pens and pencils, and arts and craft supplies, such as construction paper, glue, scissors, and erasers. Optionally, the corresponding themes can be specifically derived and tailored towards the user's own requirements, artistic needs, and desired combinations. Moreover, as best illustrated in FIG. 15, tray accessories such as removable micro trays 66 and cylindrical containers 68 may be provided in order best suit the particular artistic project.

Figure 13:
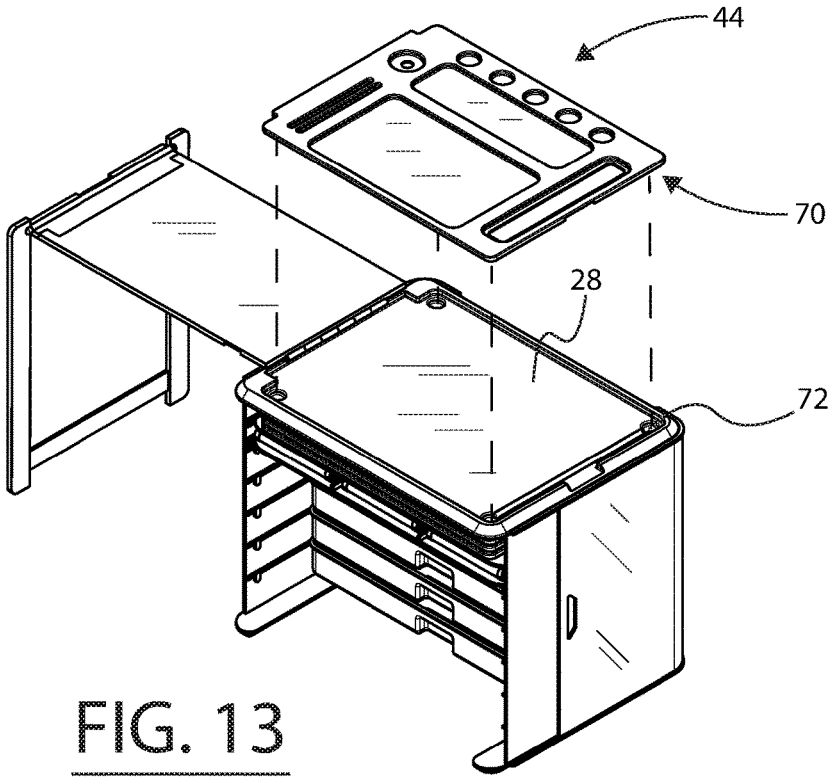
FIG. 13 is a front perspective view of the version shown in FIG. 1 while in the lateral extended position.
Figure 14:
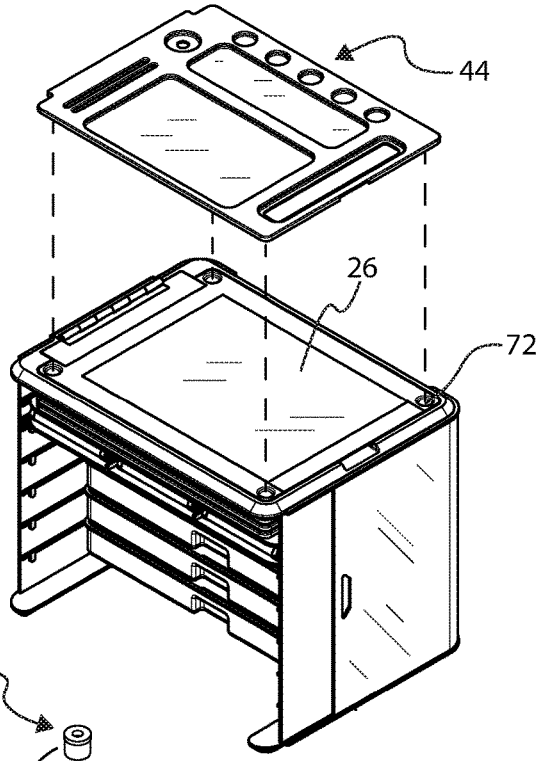
FIG. 14 is a front perspective view of the version shown in FIG. 1 shown while in the collapsed position.
Figure 18:
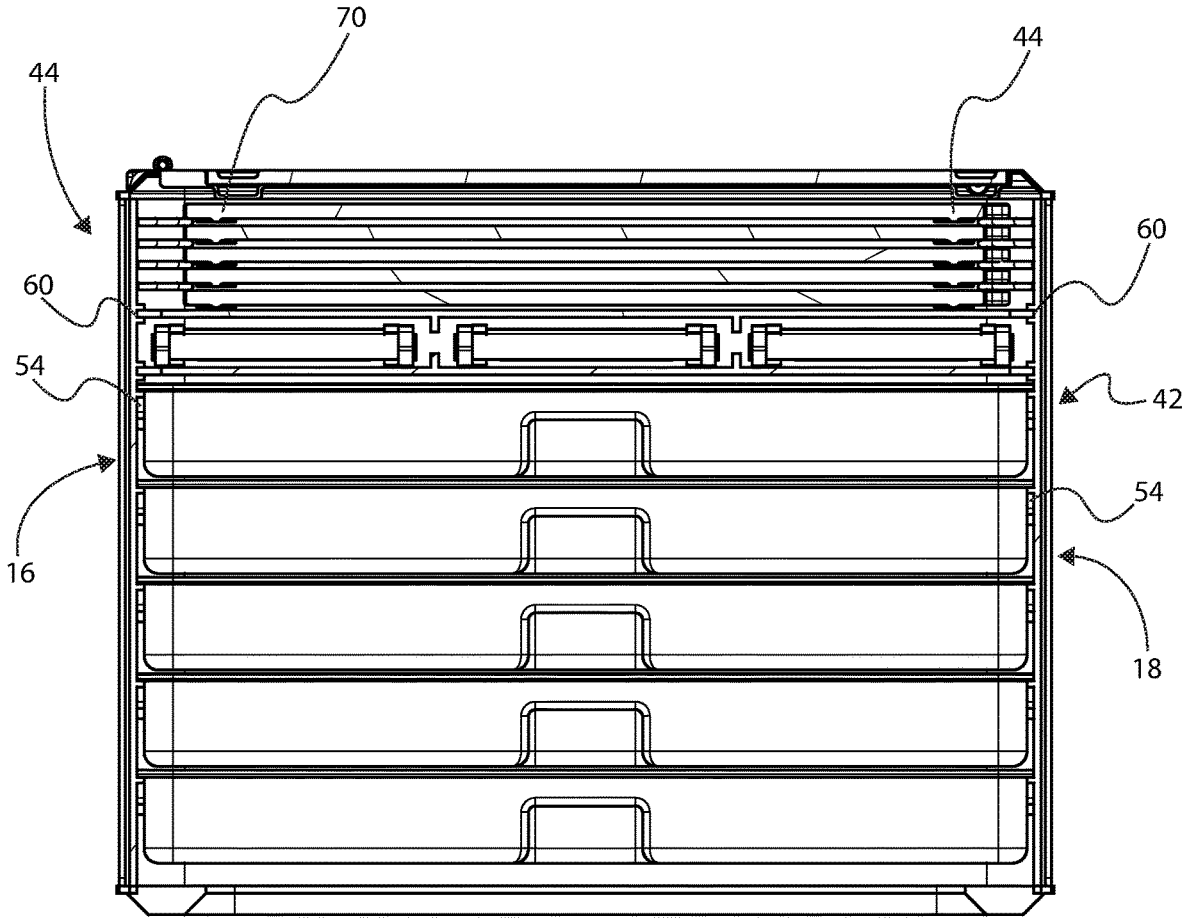
FIG. 18 is a cross-sectional view taken along the lines of A-A of FIG. 17 of the version shown in FIG. 1.
Figure 19:
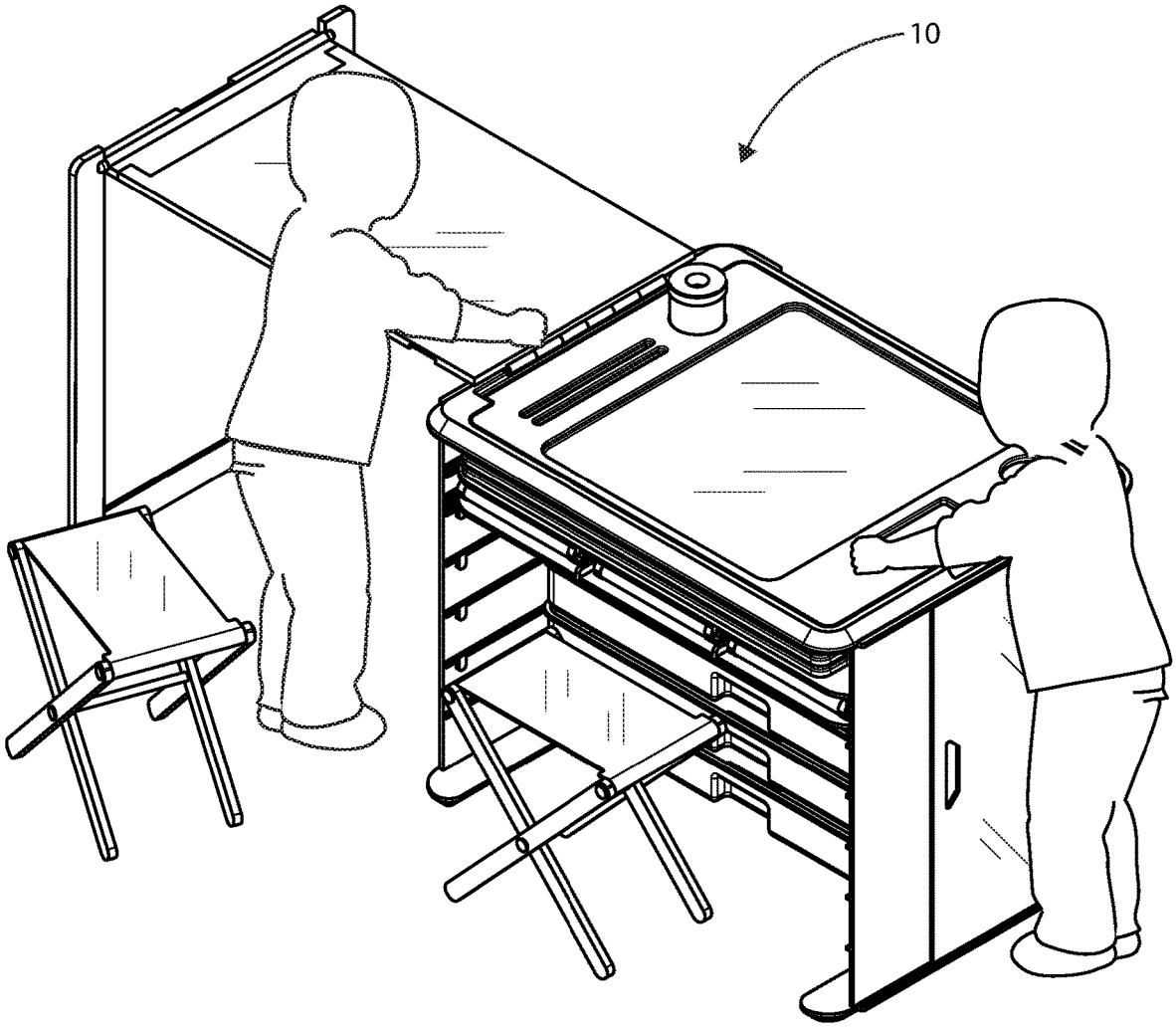
FIG. 19 is an illustrative front perspective view of the version shown in FIG. 1.

Further, as best illustrated by FIG. 13, FIG. 14, and FIG. 18, in a version of the application, the art trays 44 may be configured to couple with the top portion 21 first working surface 26 while the workstation 10 is in the collapsed position (FIG. 14) or with the static working surface 28 while the workstation 10 is in the lateral extended position (FIG. 13). In the version, the means for coupling comprises a plurality of shaped projections 70 (See FIG. 18) extending below each art tray and reciprocally positioned and shaped dimples 72 embedded within the top portion 21 working surfaces 26, 28, thereby providing lateral stability to each tray while in use in conjunction with the desk assembly 12. In the version, the shaped projections 70 and reciprocal shaped dimples 72 are positioned near the corners of the respective art trays 44 and the working surfaces 26, 28.

Figure 16:
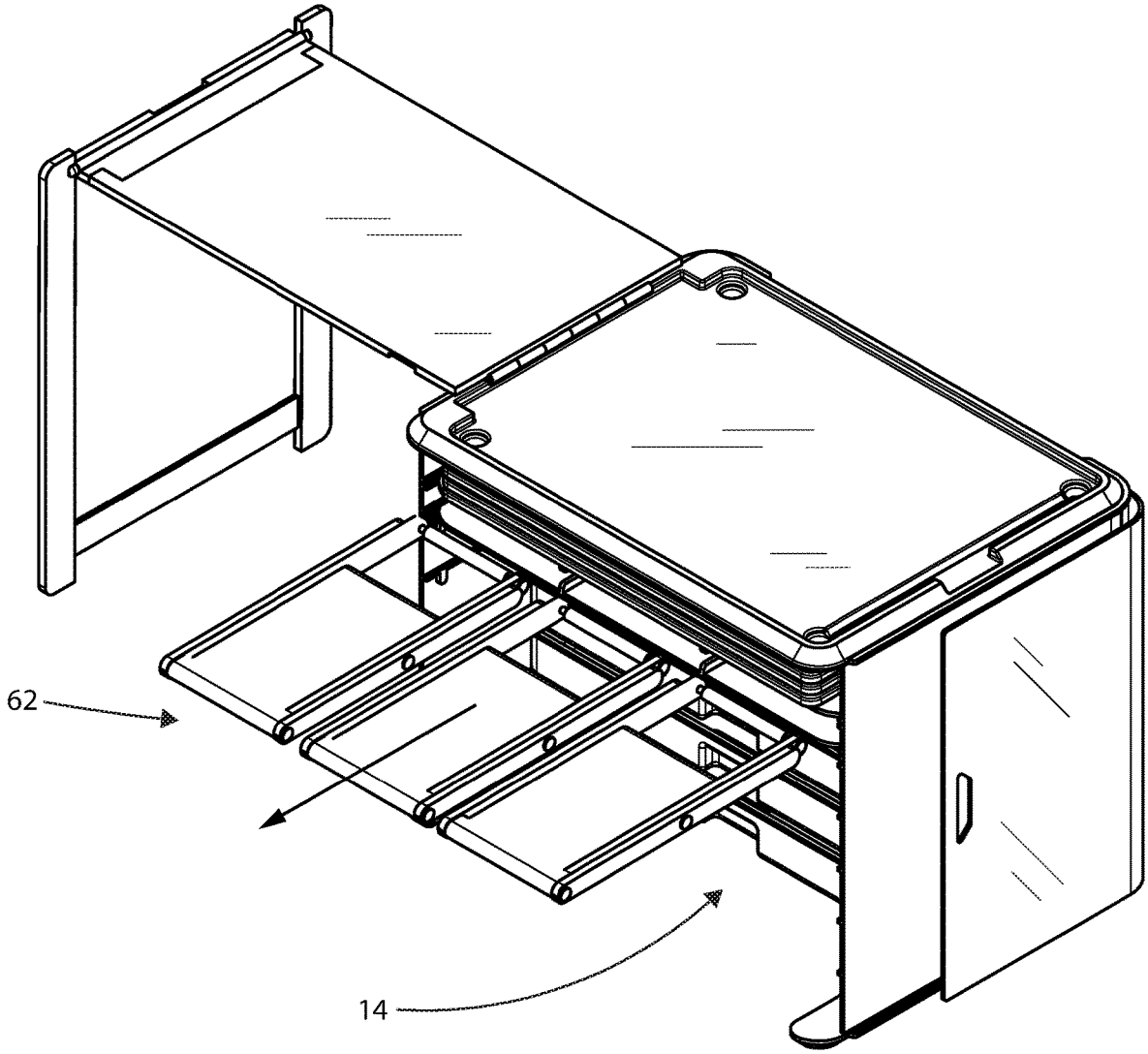
FIG. 16 is a front perspective view of the version shown in FIG. 1 while the chairs are removed from the art station and while in the lateral extended position.
Figure 17:
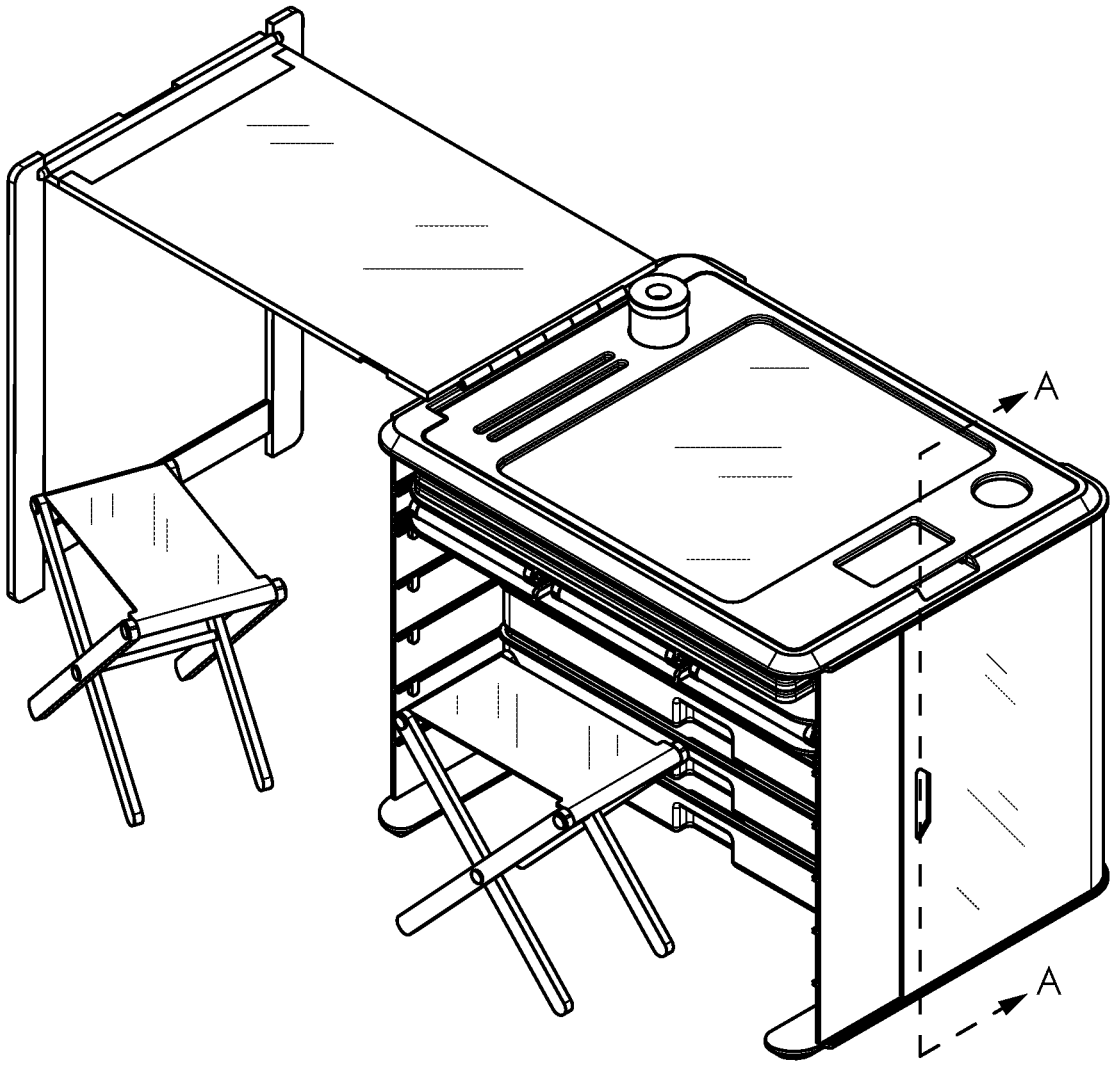
FIG. 17 is a front perspective view of the version shown in FIG. 1 while the chairs are positioned about the art station while in the lateral extended position.

Referring now to FIG. 16 and FIG. 17, the art station 10 may further comprise one or more chairs 62 designed for seating about the desk assembly 12. Ideally, the chairs 62 are foldable forming a limited profile such that they can be stowed in the storage cavity 14. Ideally, the chairs 62 are positioned at a middle level 64 between the first designated level 52 storing the art containers 42 and the second designated level 58 storing the art trays 44 (See FIG. 12).

The art station 10 can be made in any manner and of any material chosen with sound engineering judgment. Preferably, materials will be strong, lightweight, long-lasting, economical, ergonomic, and eco-friendly.

The invention does not require that all the advantageous features and all the advantages need to be incorporated into every version of the invention.

Although preferred embodiments of the invention have been described in considerable detail, other versions and embodiments of the invention are certainly possible. Therefore, the present invention should not be limited to the described embodiments herein.

All features disclosed in this specification including any claims, abstract, and drawings may be replaced by alternative features serving the same, equivalent or similar purpose unless expressly stated otherwise.

What is claimed is:

1. A workstation comprising:

a desk assembly forming a box-like storage cavity comprising: a first side frame, a second side frame, rear side frame, and a top portion having at least one working surface;

a plurality of grouped art containers arranged within the storage cavity at a first level, each container having a width, depth and a height configured to be independently slidably removable from the storage cavity; and a plurality of grouped art trays arranged within the storage cavity at a second level positioned above the plurality of grouped art containers, each tray having a width, depth and a height configured to be independently slidably removable from the storage cavity; and a plurality of foldable chairs arranged within the storage cavity at a middle level between the first level storing the art containers and the second level storing the art trays;

wherein the height of each of the grouped art trays is less than the height of each of the plurality of grouped art containers, and the depth of the plurality of grouped art containers is less than the depth of the plurality of grouped art trays.

2. The workstation of claim 1, further comprising a front portion having a pair of slidable doors which are configured to slide apart, merge and conceal with the corresponding profile of the first and second side frames for accessing the storage cavity.

3. The workstation of claim 1, further comprising an extendable top portion comprising: a static working surface having opposing sides; a moveable planar structure having a first working surface and an opposing second working surface, the moveable planar structure hingedly connected near where the top portion merges with one of the side frames; a support leg structure hingedly connected to the moveable planar structure; and wherein the extendable top portion extends from a collapsed position to a laterally extended position, wherein while in the collapsed position, only the first working surface is exposed and while in the laterally extended position, only the static working surface and the second working surface is exposed forming together an overall working surface supported at a distal end by the support leg structure.

4. The workstation of claim 1, wherein each art tray comprises a means for coupling with one of the working surfaces.

5. The workstation of claim 4, wherein the means for coupling comprises a plurality of shaped projections extending below each art tray and reciprocally positioned and shaped dimples embedded within one of the working surfaces, thereby providing lateral stability to each tray while in use.

6. The workstation of claim 1, wherein the quantity of art trays equals the number of art containers.

7. A workstation comprising:

a desk assembly forming a box-like storage cavity comprising: a first side frame, a second side frame, rear side frame, and a top portion having at least one working surface;

a plurality of grouped art containers arranged within the storage cavity at a first level, each container having a width, depth and a height configured to be independently slidably removable from the storage cavity;

a plurality of grouped art trays arranged within the storage cavity at a second level positioned above the plurality of grouped art containers, each tray having a width, depth and a height configured to be independently slidably removable from the storage cavity; and an extendable top portion comprising: a static working surface having opposing sides; a moveable planar structure having a first working surface and an opposing second working surface, the moveable planar structure hingedly connected near where the top portion merges with one of the side frames; a support leg structure hingedly connected to the moveable planar structure; and wherein the extendable top portion extends from a collapsed position to a laterally extended position, wherein while in the collapsed position, only the first working surface is exposed and while in the laterally extended position, only the static working surface and the second working surface is exposed forming together an overall working surface supported at a distal end by the support leg structure;

wherein the height of each of the grouped art trays is less than the height of each of the plurality of grouped art containers, and the depth of the plurality of grouped art containers is less than the depth of the plurality of grouped art trays.

8. The workstation of claim 7, further comprising a front portion having a pair of slidable doors which are configured to slide apart, merge and conceal with the corresponding profile of the first and second side frames for accessing the storage cavity.

9. The workstation of claim 7, wherein each art tray comprises a means for coupling with one of the working surfaces.

10. The workstation of claim 9, wherein the means for coupling comprises a plurality of shaped projections extending below each art tray and reciprocally positioned and shaped dimples embedded within one of the working surfaces, thereby providing lateral stability to each tray while in use.

11. The workstation of claim 7, wherein the quantity of art trays equals the quantity of art containers.

12. A workstation comprising:

a desk assembly forming a box-like storage cavity comprising: a first side frame, a second side frame, rear side frame, and a top portion having at least one working surface;

a plurality of grouped art containers arranged within the storage cavity at a first level, each container having a width, depth and a height configured to be independently slidably removable from the storage cavity;

a plurality of grouped art trays arranged within the storage cavity at a second level positioned above the plurality of grouped art containers, each tray having a width, depth and a height configured to be independently slidably removable from the storage cavity;

a plurality of foldable chairs arranged within the storage cavity at a middle level between the first level storing the art containers and the second level storing the art trays; and an extendable top portion comprising: a static working surface having opposing sides; a moveable planar structure having a first working surface and an opposing second working surface, the moveable planar structure hingedly connected near where the top portion merges with one of the side frames; a support leg structure hingedly connected to the moveable planar structure; and wherein the extendable top portion extends from a collapsed position to a laterally extended position, wherein while in the collapsed position, only the first working surface is exposed and while in the laterally extended position, only the static working surface and the second working surface is exposed forming together an overall working surface supported at a distal end by the support leg structure;

wherein the height of each of the grouped art trays is less than the height of each of the plurality of grouped art containers, and the depth of the plurality of grouped art containers is less than the depth of the plurality of grouped art trays.

13. The workstation of claim 12, further comprising a front portion having a pair of slidable doors which are configured to slide apart, merge and conceal with the corresponding profile of the first and second side frames for accessing the storage cavity.

14. The workstation of claim 12, wherein each art tray comprises a means for coupling with one of the working surfaces.

15. The workstation of claim 14, wherein the means for coupling comprises a plurality of shaped projections extending below each art tray and reciprocally positioned and shaped dimples embedded within one of the working surfaces, thereby providing lateral stability to each tray while in use.

* * * * *